United States Patent [19]

Strunz et al.

[11] 4,059,395

[45] Nov. 22, 1977

[54] DEVICE FOR REMOVING CARBONIZABLE RESIDUES

[75] Inventors: Dieter O. Strunz, Nurnberg; Wolfgang Kern, Ebertraunsdorf, both of Germany

[73] Assignee: Siemens Aktiengesellschaft, Erlangen, Germany

[21] Appl. No.: 667,142

[22] Filed: Mar. 15, 1976

[30] Foreign Application Priority Data

Mar. 21, 1975 Germany ..... 2512603

[51] Int. Cl.[2] ..... F23J 15/00; F27B 5/04

[52] U.S. Cl. ..... 432/72; 266/144; 266/156; 432/21; 432/26; 432/198

[58] Field of Search ..... 432/21, 26, 2, 66, 72, 432/152, 198, 222; 266/144, 145, 156

[56] References Cited

U.S. PATENT DOCUMENTS

| | | | |
|---|---|---|---|
| 1,179,192 | 4/1916 | Kleinschmidt | 432/66 |
| 1,371,914 | 3/1921 | Lewis et al. | 432/66 |
| 2,097,620 | 11/1937 | Harris | 432/26 X |
| 3,127,156 | 3/1964 | Shepherd | 432/26 |
| 3,947,235 | 3/1976 | Bornert | 432/72 |

*Primary Examiner*—John J. Camby
*Attorney, Agent, or Firm*—Herbert L. Lerner

[57] ABSTRACT

Device for removing carbonizable residues includes a closed furnace heatable to low-level carbonization temperature, the furnace having an outlet for carbonization gases formed therein, means for burning off carbonization gases from carbonizable residues and utilizing the heat of combustion therefrom for heating the furnace, the means comprising a burner and a combustion chamber connected to the burner and forming part of a hot gas circulatory system, the hot gas circulatory system also including a container wherein the furnace is disposed so as to be heatable by hot gas circulating through the hot gas circulatory system, a carbonization gas return line connecting the furnace and the combustion chamber for returning to the combustion chamber carbonization gases formed in the furnace, and an inert gas line communicating with the interior of the furnace for supplying inert gas thereto.

9 Claims, 1 Drawing Figure

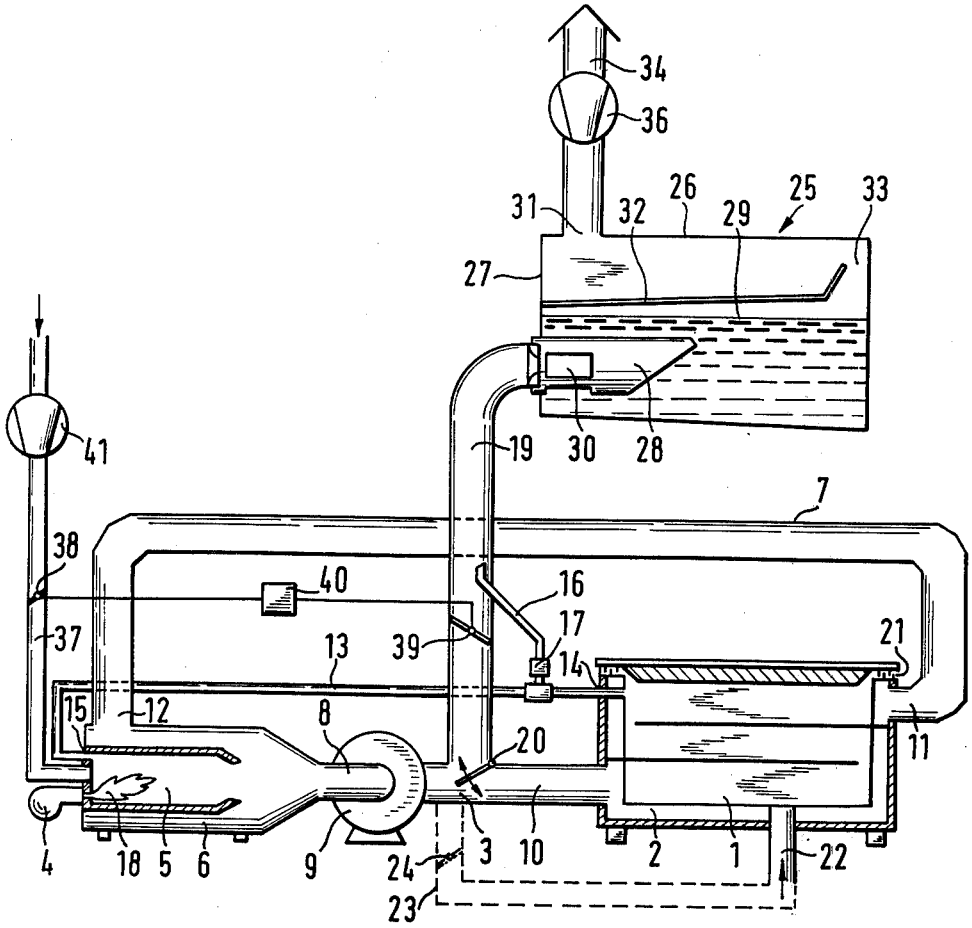
34
36
31
32
26
29
25
33
27
41
19
30
28
7
38
40
16
17
37
13
39
14
21
15
12
8
20
11
4
18
5
6
9
24
3
10
2
1
22
23

DEVICE FOR REMOVING CARBONIZABLE RESIDUES

The invention relates to a device for removing carbonizable residues, such as lacquer, for example. In our earlier German Pat. No. 2,247,861, we disclosed a device for removing lacquer residues on parts of equipment in a closed furnace heated to carbonization temperature and formed with an outlet for carbonization gases, the heat of combustion being utilized for heating the furnace. In our aforementioned German patent, the furnace is disposed in a container wherein it is heated by hot gas, the container being connected into a hot gas circulatory system also including a combustion chamber with which a carbonization gas return line is associated.

With the device of the invention in the instant application, uniform carbonization with uniform temperature distribution in the furnace and consequently slight stress formation in the equipment parts is assured, reliable destruction of the carbonization gases and accordingly an odorless and dirt-free or soot-free operation of the deivce being stressed. It has been found, however, that the destruction of the carbonization gases can be further improved i.e. the odorless and soot-free operation of the device can be further increased by means of the improved features of the invention of the instant application.

It is accordingly an object of the invention to provide an improved device of the foregoing type which accordingly effects an improved destruction of the carbonization gases and has a more efficient odorless and soot-free operation.

With the foregoing and other objects in view, there is provided, in accordance with the invention, a device for removing carbonizable residues comprising a closed furnace heatable to low-level carbonization temperature, the furnace having an outlet for carbonization gases formed therein, means for burning off carbonization gases from carbonizable residues and utilizing the heat of combustion therefrom for heating the furnace, the means comprising a burner and a combustion chamber connected to the burner and forming part of a hot gas circulatory system, the hot gas circulatory system also including a container wherein the furnace is disposed so as to be heatable by hot has circulating through the hot gas circulatory system, a carbonization gas return line connecting the furnace and the combustion chamber for returning to the combustion chamber carbonization gases formed in the furnace, and an inert gas line communicating with the interior of the furnace for supplying inert gas thereto.

The inert gas line which is provided in accordance with the invention conducts, for example, nitrogen or $CO_2$ gas to the furnace. This supply of inert gas affords the advantage that danger of explosion, especially when introducing the equipment parts into the furnace, is minimized because when introducing the equipment parts therein and the furnace is closed, a given inclusion of air i.e. oxygen, occurs which can cause destruction or damage to the equipment parts, for example, through annealing or heat treatment resulting from explosion phenomena or the like. Furthermore, energy costs are economized thereby because a smaller time span is required for building up the pressure within the furnace, inasmuch as the combustion gas is introduced more rapidly into the combustion chamber and the charging time is accordingly shortened due to the application of pressure to the inert gas. Heretofore, the carbonization gases were introduced virtually through self-drive or under their own pressure into the combustion chamber. Metering of the quantity of inert gas is capable of being effected relatively simply when, in accordance with the invention, the pump means which are connected in the hot gas circulatory system for circulating hot gas therethrough are operatively connected to the inert gas line for feeding inert gas therethrough to the furnace, without requiring any additional pump. The quantity of inert gas being fed is achieved by suitable dimensioning of the pipe line.

In accordance with another feature of the invention, the inert gas line extends through the bottom of the furnace into the interior thereof, thereby essentially accelerating the upward drive of heavy gases. If the inert gas line were contrarily introduced at the upper region of the furnace and the combustion chamber supply line were connected in the vicinity of the bottom of the furnace, there would be a disadvantage in that clogging of the outlet by ash might occur, and locating the furnace above the combustion chamber would result in poor accessibility of the furnace for the purpose of the servicing thereof.

In accordance with yet another feature of the invention, a gas washer is connected to a waste gas discharge line extending from the hot gas circulatory system, which ensures reliable destruction of the carbonization gas and thereby improved odorless and soot-free operation of the device of the invention. This is especially advantageous in the combustion of synthetic materials, especially PVC residues because hydrochloric acid is formed in the process, which can damage the equipment and also should not be blown into the atmosphere. In addition to the hydrochloric acid, further non-combustible destructive solids can thereby be washed out of the gases.

In accordance with an additional feature of the invention, a smoke stack is connected to the gas washer and auxiliary blower means are provided in the smoke stack. The provision of this feature affords the advantage that the auxiliary blower means per se does not have to be acid-resistant. The auxiliary blower means per se ensures production of the required through-put velocity for the gases.

In accordance with an added feature of the invention, the gas washer comprises a housing, a substantially horizontally extending deflecting plate mounted in the housing, a lateral inlet formed in the housing below the deflecting plate, the deflecting plate having a gas passageway at a side thereof opposite the side overlying the inlet thereto, the housing being formed with a gas outlet at a location thereof above the deflecting plate at the side of the deflecting plate overlying the inlet. In this relatively simple manner assurance is provided that the gas flow released into the smoke stack through the relatively long path traversible thereby until it enters the smoke stack will be released in relatively dry condition into the surrounding air.

In accordance with a concomitant feature of the invention, a controllable secondary air line is provided communicating with the combustion chamber. Other features which are considered as characteristic for the invention are set forth in the appended claims.

Although the invention is illustrated and described herein as embodied in the device for removing carbonizable residues, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic view of the device for removing carbonizable residues in accordance with the invention.

Referring now to the drawing, there is shown therein, a device for removing lacquer residues from parts of equipment according to the invention, which includes a furnace essentially closed in itself and heated to low-level carbonization temperature wherein the non-illustrated equipment parts, such as kiln bases also, are disposed. The furnace 1 per se is located in a container or vessel 2 which is connected to a hot-gas circulating system 3 which provides for hot gas heating of the furnace 1. The hot-gas circulating system 3 includes a burner 4, such as an oil burner, for example, a combustion chamber 5 to which the burner 4 is connected, a mixing chamber 6 surrounding and communicating with the combustion chamber 5, as well as lines 7 and 8 connected to the mixing chamber 6. The line 8 connects through a blower or ventilator 9 and an inlet connecting pipe 10 to the lower part of the container or vessel 2, while the pipeline 7, on the other hand, assumes the function of an actual return line for the hot gas from the container or vessel 2 to the mixing chamber 6, and is accordingly connected through an outlet connecting pipe 11 to the container or vessel 2, on the one hand, and through an inlet connecting pipe 12 to the mixing chamber 6, on the other hand. The inlet connecting pipe 12 ends in a region above the combustion chamber 5, so that the cooled-off hot gas above the combustion chamber 5 is heated again before it enters the mixing chamber 6.

A carbonization gas return line 13 is connected to the upper end 14 of the furnace 1 and ends at a location 15 in the combustion chamber 5. A by-pass line 16 operable in response to a disruption of or disturbance in the burner 4, for example through a magnetic valve 17, which is controlled in response to the presence of a flame 18, when an oil burner is used, is connected to the carbonization gas return line 13. The by-pass line 16 terminates in a waste gas chimney 19 which is connected through a control flap 20 to the pipeline 8 of the hot gas circulating system 3. The control flap 20 is controlled temperature-dependently by the carbonization gases i.e. by the furnace temperature, the control flap 20 being always open to a given extent. The control flap 20 prevents overheating or forming excess pressure in the furnace 1. A defined inlet opening 21 for the furnace 1 serves at least without any inert-gas line as oxygen supply equipment. The inlet opening 21 is of such dimension that the oxygen necessary for the carbonization process, during the formation of excess pressure in the furnace can enter the furnace.

An inert-gas line 22 extends into the furnace 1 at the base thereof, any may be connected to an inert-gas storage source represented by the arrow 22', for example a nitrogen or $CO_2$ bottle or tank, the gas from which may be blown in suitable metered quantity into the line 22. In the illustrated embodiment, however, the line 22 has a connection 23, as shown by the dotted lines, to the pipeline 8 behind or downstream of the blower 9. A valve 24 is provided in the connecting line 23 and provides a means for effecting a metering of the inert gas introduction. The valve 24 is of particular interest for closing the inert-gas line 22 after the termination of a charge and also if the burner 4 should fail or break down. Not illustrated is a device which is insertable into the connecting line 23 for filtering inert gases out of the pipe-line 8. In the event insufficient inert gas is present in the line 8, a mixture of inert gas from the storage source 22' and gas from the pipeline 8 can also be provided. If the inert-gas line 22 is suitably coordinated, the inlet opening 21 may be dispensed with.

Furthermore, a secondary-air line 37 extends into the combustion chamber 5. The secondary-air line 37 is closeable through a secondary-air flap 38 which, together with a waste gas control flap 39, is, in turn, operatively dependent upon an adjusting device 40, such as a switch responsive to a given temperature. The temperature to which the switch 40 is responsive is sensed by a temperature sensor 42 disposed in the mixing chamber 6 and has the given value due to a rise therein resulting from a return of combustion gas from the furnace 1 to the combustion chamber 5. The adjusting device or switch 40 reacts to the given temperature by opening the butterfly valves 38 and 39 simultaneously. In addtion, a secondary air blower 41 is provided connected to the secondary air line 37.

The waste gas chimney 19 extends into a gas washer 25 formed of a housing 26, in a lateral wall 27 of which a tubular inlet 28 is installed. The tubular inlet 28 is disposed in a liquid 29 and is formed with lateral outlet openings 30. Gases discharging in this region i.e. from the outlet openings 30, cannot directly reach the gas outlet opening 31 at the top of the housing 26, because a deflecting plate 32 is disposed above the surface of the liquid 29. The deflecting plate 32 has a gas passage or outlet 33 at the side thereof opposite the side at which the inlet 28 is located, so that gas emerging from the liquid 29 must travel along a relatively lengthy path and thereby pass through the gas outlet opening 31 in virtually dry condition and consequently discharge in that condition from the smoke stack 34 which is connected to the outlet opening 31.

The aforedescribed device for removing lacquer residues, as shown in the drawing, functions in the following manner:

Heating oil introduced by the burner 4 into the combustion chamber 5 is burned at a temperature of about 1400° C. The hot gases are mixed in the mixing chamber 6 to a reduced temperature of 800° C and conducted through the blower 9, in accordance with the counterflow principle, to the furnace 1. The hot gas discharging from the outlet connecting pipe 11 are conducted through the pipeline 7 and the inlet connecting pipe 12 to the outer wall of the combustion chamber 5 and return from there to the mixing chamber 6. The burner 4 can advantageously have a two-or more-stage switching circuit wherein the smallest stage ensures that the carbonization gas entering the combustion chamber 5 through the carbonization gas return line 13 ignites reliably. The additional stages for the burner 4 serve, for example, to heat the furnace 1 rapidly so that altogether the operation can be maintained with relatively low burner power.

The lacquer residues carbonized at low temperature from the equipment parts placed in the furnace 1 when the latter is heated up produce carbonizaton gases which discharge through the upper end 14 of the furnace 1 and, as aforementioned, undergo complete combustion in the combustion chamber 5, so that there is a virtual elimination or exclusion of any annoyance of the local residents resulting from odors and polluting dirt. The combustion chamber 5, as shown in the drawing, is of relatively elongated construction, so that, inasmuch as the combustion chamber 5 per se is at a temperature necessary for ignition, it presents a relatively long travel path for the carbonization gases and thereby makes available a relatively long time period for the combustion of the carbonization gases, whereby even those gas components which are inflammable or ignitable with greater difficulty can be reliably burned. Consequently, it is advantageous that if the flame 18 should go out or fail, a short period remains during which further combustion of the carbonization gases occurs. If the flame 18 should go out, for example, and reliable combustion of the carbonization gases is no longer assured, the magnetic valve 17 opens and permits the carbonization gas to pass through the by-pass line 16 into the waste gas chimney 19. Since the waste gas chimney 19 is being traversed by hot gas, as a rule, due to the easily opened control flap 20, the carbonizaton gases that are being led off are not cooled back to the same extent as in a cold chimney, so that no partial fusion of the carbonization gases occurs. The removal, in this manner, of the carbonization gases from the circulating system 3 serves to avoid detonations or deflagrations in the system when the burner 4 cuts off. The control flap 20 affords a given equalization or equilibrium of the hot gas circulation with the outer air, which is determinable in accordance with the extent to which the control flap 20 is opened. If the burner 4 is switched to the smallest or lowest setting, the control flap 20 can be largely closed whereas, for a further increasing furnace temperature, even with a small or low burner setting, opening of the control flap 20 can be effected so that the furnace temperature can remain virtually constant.

The gases fed into the combustion chamber 5 through the carbonization gas return line 13 require additional combustion air which, in the normal situation, is aspirated or sucked in through the burner 4, in which, however, results in the burner 4 not being controllable in the desired manner. The secondary air line 37 advantageously permits unhampered utilization of the burner 4 with any desired quantity of carbonization gas that is supplied through the line 13. The action of the adjusting device 40 is dependent upon the quantity of carbonization gas, and the adjusting device 40 adjusts the secondary air flap 38 together with the waste gas quantity control flap 39, accordingly, in the same direction. The waste gas quantity control flap 39 is constructed so that the waste gas produced in the normal case by the burner 4, can escape through the waste gas chimney 19. The moment additional secondary air is sucked in through the secondary air control flap 38, the waste gas quantity control flap 39 is opened further. The secondary air blower 41 permits the secondary air line 37 to be provided with any desired dimension independently of the cross section thereof.

Due to the supply of the inert gas through the line 22, the carbonization at lower temperature is carried out within the furnace 1 without any danger of explosion and without any annealing or heat treatment of the material of the equipment that is inserted therein. The carbonization gases, as aforedescribed, are conducted into the waste gas chimney 19 and accordingly introduced into the washer 25. After being deflected by the deflecting plate 32, the gases discharge into the open air through the smoke-stack 34. In order to equalize or balance the resistance which must be overcome by the carbonizing gases when passing through the liquid 29, it is advantageous, in accordance with the invention, to install a blower 36 acting as a suction-draft blower in the smoke-stack 34.

In addition to lacquer per se, any similar or dissimilar material which is carbonizable, such as synthetic residue including cable insulation, is also readily removable by the device of the invention.

In the gaswasher 25 is normaly used water as liquid 29 with a additive for neutralisation of the gas.

There are claimed:

1. Device for removing carbonizable residues comprising a closed furnace heatable to low-level carbonization temperature, said furnace having an outlet for carbonization gases formed therein, means for burning off carbonization gases from carbonizable residues and utilizing the heat of combustion therefrom for heating the furnace, said means comprising a burner and a combustion chamber connected to said burner and forming part of a hot gas circulatory system, said hot gas circulatory system also including a container wherein said furnace is disposed so as to be heatable by hot gas circulating through said hot gas circulatory system, and a hot gas return line connecting said container with a mixing chamber communicating with said combustion chamber, a carbonization gas return line connecting said furnace and said combustion chamber for returning to said combustion chamber carbonization gases formed in said furnace, and an inert gas line communicating with the interior of said furnace for supplying inert gas thereto.

2. Device according to claim 1 including pump means connected in said hot gas circulatory system for circulating hot gas therethrough, said pump means being operatively connected to said inert gas line for feeding inert gas therethrough to said furnace.

3. Device according to claim 1 wherein said inert gas line extends through the bottom of said furnace into the interior thereof.

4. Device according to claim 1 wherein said inert gas line extends from said hot gas circulatory system so as to feed inert gas therefrom into said furnace.

5. Device according to claim 1 including valve means connected in said inert gas line.

6. Device according to claim 1 including a gas washer, and a waste gas discharge line connected from said hot gas circulatory system to said gas washer.

7. Device according to claim 6 including smoke stack means connected to said gas washer, and auxiliary blower means located in said smoke stack means.

8. Device according to claim 7 wherein said gas washer comprises a housing, a substantially horizontally extending deflecting plate mounted in said housing, a lateral inlet formed in said housing below said deflecting plate, said deflecting plate having a gas passageway at a side thereof opposite the side overlying said inlet, said housing being formed with a gas outlet at a location thereof above said deflection plate at the side of said deflecting plate overlying said inlet.

9. Device according to claim 1 including a controllable secondary air line communicating with said combustion chamber.

* * * * *